United States Patent [19]

Labarthe

[11] Patent Number: 5,036,984

[45] Date of Patent: Aug. 6, 1991

[54] METHOD FOR ENABLING PRIORITIZED PROCESSING OF ENVELOPES ACCORDING TO ENCODED INDICIA OF POTENTIALLY ENCLOSED CHECKS

[75] Inventor: Larry C. Labarthe, Dallas, Tex.

[73] Assignee: ElectroCom Automation, Inc., Arlington, Tex.

[21] Appl. No.: 411,204

[22] Filed: Sep. 21, 1989

Related U.S. Application Data

[63] Continuation of Ser. No. 896,388, Aug. 13, 1986, abandoned.

[51] Int. Cl.[5] ..... B07C 3/00

[52] U.S. Cl. ..... 209/313; 209/584; 209/900

[58] Field of Search ..... 209/3.1–3.3, 209/569, 583, 584, 900; 235/375, 379; 364/401, 406, 408; 382/7, 57; 283/57, 58, 70, 74; 229/921

[56] References Cited

U.S. PATENT DOCUMENTS

| | | | |
|---|---|---|---|
| 734,077 | 7/1903 | Mann et al. | 283/70 |
| 2,056,382 | 10/1936 | Ayres et al. | 209/584 |
| 2,669,354 | 2/1954 | Perrin | 209/583 |
| 2,675,170 | 4/1954 | Sebesta | 209/900 X |
| 2,693,909 | 11/1954 | Allan | 364/406 X |
| 2,709,001 | 5/1955 | Stahl | 209/900 X |
| 2,775,405 | 12/1956 | Paston | 209/584 X |
| 3,105,908 | 10/1963 | Burkhardt et al. | 209/900 X |
| 3,531,628 | 9/1970 | White, Jr. | 283/57 X |
| 3,652,830 | 3/1972 | Kessler | 283/74 X |
| 3,790,193 | 2/1974 | McBride | 283/57 |
| 3,895,220 | 7/1975 | Nelson et al. | 209/900 X |
| 3,933,094 | 1/1976 | Murphy et al. | 209/900 X |
| 4,090,611 | 5/1978 | McKinney | 209/584 X |
| 4,117,975 | 10/1978 | Gunn | 209/584 X |
| 4,158,835 | 6/1979 | Miura et al. | 209/900 X |
| 4,317,030 | 2/1982 | Berghell | 209/900 X |
| 4,358,017 | 11/1982 | Erikson | 209/584 |

FOREIGN PATENT DOCUMENTS

| | | | |
|---|---|---|---|
| 0115236 | 8/1984 | European Pat. Off. | 209/584 |
| 1083583 | 6/1960 | Fed. Rep. of Germany | 209/584 |
| 2108072 | 8/1971 | Fed. Rep. of Germany | 209/584 |
| 2144697 | 3/1973 | Fed. Rep. of Germany | 209/900 |
| 2236565 | 2/1975 | France | 209/900 |
| 2097330 | 11/1982 | United Kingdom | 209/584 |

OTHER PUBLICATIONS

"*The Many Keys to Lockbox Success*", ABA Banking Journal, May 1986, pp. 98–104.

Suburban Trust Company, One Page, Sep. 1960, copy in 283/57.

*Primary Examiner*—Margaret A. Focarino
*Assistant Examiner*—Edward M. Wacyra
*Attorney, Agent, or Firm*—Vaden, Eickenroht, Thompson & Boulware

[57] ABSTRACT

A method for enabling, without first opening the envelope, prioritized processing of envelopes according to indications of clearing organization(s) of potentially enclosed checks. The method is rapidly executed by high speed automatic sorters operating on appropriate encoded indicia supplied to drawers of checks in such a way that the indicia is detectable from unopened envelopes delivering the checks.

2 Claims, 1 Drawing Sheet

METHOD FOR ENABLING PRIORITIZED PROCESSING OF ENVELOPES ACCORDING TO ENCODED INDICIA OF POTENTIALLY ENCLOSED CHECKS

This application is a continuation of application Ser. No. 06,896,388, filed Aug. 13, 1986, now abandoned.

BACKGROUND OF THE INVENTION

1. Field of the Invention

This invention relates to a method for enabling prioritized processing of envelopes potentially containing checks according to indicia of the individual check's clearing organization. More particularly, this invention relates to using intelligence or materials supplied to a drawer of checks to encode indicia of the drawer's checks, the intelligence or materials being designed to accompany the drawer's check and envelope when delivered to the payee, or payee's designated agent, in such a manner that the encoded indicia is readable from the unopened delivered envelope.

2. Description of the Prior Art

There are several potential uses for applicant's invention. Bank Lock Box operations form one particular user group. A Lock Box is a specialized function within a large bank. The bank's Lock Box customers furnish their remittors with addresses that send remittances directly to the Lock Box. The Lock Box becomes the Lock Box customer's designated agent for receiving remittances due the Lock Box customer. The address furnished to the remittor contains a code, such as a box number, identifying the Lock Box customer as the payee. A Lock Box operation typically receives 10,000 to 200,000 payment checks per day. These checks are usually in amounts of $2,000 to $1,000,000.

Sending remittances directly to the Lock Box speeds the collection process on the check and thus moves earlier the time at which the Lock Box customer and/or the depositary bank can begin to draw interest on the remittance amount. "Float", defined as the time between the receipt of the check and the crediting of the amount of the check to the account of the Lock Box customer and/or the bank, is thereby minimized. Minimizing float enhances earnings for the bank and the Lock Box customer.

Credit for the amount of a check is accorded a depositary or collecting bank in the following manner. The depositary or collecting bank periodically forwards "cash letters" to appropriate check clearing organizations. Cash letters present checks (collected at the depositary or collecting bank, payable to customers of the depositary or collecting bank) whose payor banks "clear" through that clearing organization. A clearing organization may be the payor bank itself, a clearing house bank or agent or a member of the Federal Reserve Bank System. Cash letters are typically wired in, followed by a physical presentation of the letter and the checks.

Each clearing organization has one or more daily cash letter "deadlines". Cash letters that reach a clearing organization by one of the daily cash letter deadlines are credited then to the depositary or collecting bank's account. The amount of the cash letter begins to draw interest for that depositary or collecting bank based on the "availability schedule" of each clearing house member bank or payor bank for the specific cash letter deadline.

A depositary or collecting bank may utilize, depending on its level of business, various transportation (and/or possibly communication) means to meet cash letter deadlines. It is not uncommon for messengers daily to hand-carry cash letters with checks via helicopters and commercial airlines to accelerate funds collection to reduce float. The transportation/communications means selected by a bank for meeting various clearing organization daily cash letter deadlines establishes, in turn, its own in-house outgoing deadlines for cash letters destined for those clearing organizations.

It is clearly in the bank's best interest to discover, from the multitude of checks entered into the collection process in the bank, as many as possible of the checks destined to clear at a specific clearing organization by the outgoing deadline established in-house for such organization's cash letter. Such an operational methodology minimizes float.

A Lock Box operation, according to current art, typically handles incoming items in the following manner. Mail is delivered to the Lock Box throughout the day and night, perhaps hourly or half-hourly. Incoming envelopes are sorted according to Lock Box customer based on information encoded in the address (i.e., usually a box number) supplied to the remittor. All of the envelopes sorted by Lock Box customers are then opened, processed and only as the last step, are the enclosed checks sorted according to check clearing organizations.

This final sorting of checks based on clearing organizations is normally performed in a centralized bank service area, frequently called the Transit or clearing operation (Transit). Transit performs this sorting function for those departments at the bank engaged in check funds receipt and forwarding, including the Lock Box. If Transit is utilized for the sort according to check clearing organization, an earlier cut-off deadline for checks out of Lock Box into Transit must be set prior to each outgoing cash letter deadline. According to the number of checks usually presented by the Lock Box to Transit before an outgoing deadline, a Transit processing time is determined. The earlier cut-off deadline for checks out of Lock Box into Transit will be the outgoing deadline from Transit minus the determined Transit processing time. (The determined Transit processing time will also include the time required by Transit to set up, change over software programs and schedule for Lock Box check processing.) The Lock Box operation is constrained to this earlier cut-off deadline as "its" cash letter deadline. Said otherwise, there is insufficient time to process checks from Lock Box to Transit that do not reach Transit by this earlier cut-off deadline. As a result, late arriving checks from Lock Box to Transit can not be processed in time by Transit to be included in the outgoing cash letter.

This earlier cut-off deadline for checks from Lock Box to Transit has an insidious effect. The greater the average number of checks presented by Lock Box to Transit before an outgoing cash letter deadline, the longer the Transit processing time. The longer the Transit processing time, the earlier becomes the cut-off deadline for checks from Lock Box to Transit. The earlier the cut-off deadline for checks from Lock Box to Transit, the greater the number of late arriving checks in Lock Box that become excluded from a particular cash letter.

Bank scheduling factors additionally serve to inhibit the timing of Lock Box check processing in Transit.

Bankwise operations place high demands on the services of Transit. Frequently the Transit operation is a bottleneck in bank operations. Each Transit set up to process Lock Box checks involves set up, software program change over and scheduling time. As a result, the Transit operation limits the frequency at which it sets up to process Lock Box checks. Hence, a Lock Box may not present checks to Transit in an almost continuous stream. Therefore, Transit processing time for Lock Box checks prior to an outgoing cash letter cannot be practically reduced by multiplying the number of trips from Lock Box to Transit.

At the time of an outgoing deadline for a cash letter, there will be a backlog of checks that have arrived in Lock Box. The processing of that backlog of checks either has not begun or has not been completed or was completed too late to meet the cut-off deadline from Lock Box to Transit. If 20% of the checks passing through Lock Box clear through the clearing organization whose cash letter deadline has arrived, this backlog of checks should be comprised of checks 20% of which have arrived at Lock Box but have missed the cash letter. Twenty percent of the backlog misses drawing interest for the next interest period. It is also clear in the above hypothetical that 80% of the Lock Box processing time and 80% of the Transit processing time shortly prior to the in-house deadline was wasted on checks not destined to be included in the immediate cash letter.

The waste in the above situation is magnified by the fact that mail does not arrive in Lock Box at a steady rate. Each day has peak mail arrival periods and slow mail arrival periods. Wasted Lock Box processing time and wasted Transit processing time during peak mail arrival periods makes 20% of the backlog a greater absolute number.

One current practice to minimize float in Lock Box operations is to accelerate Lock Box processing in the period just before a critical in-house deadline. The acceleration is achieved by increasing manpower in the Lock Box operation. An intensive manpower solution accelerates processing and minimizes the total backlog of checks in the Lock Box, but the labor is spent indiscriminately. According to the prior hypothetical, 80% of the labor is wasted on checks whose accelerated processing is unnecessary at this time. In the normal case where there is a cut-off deadline for checks from Lock Box to Transit, that deadline must be moved even earlier in time with this intensive manpower solution since the Lock Box is now presenting a greater total number of checks to Transit just prior to a crucial deadline. A greater number of checks requires greater Transit processing time. Again, by the prior hypothetical, 80% of the processing time is not required at this moment.

To summarize, according to the present art, those checks in a Lock Box operation that are to be included in a cash letter are discovered by the last step in creating the cash letter. This last step is a sort of the checks according to check clearing organization. The sort may be performed, and normally is, in a Transit operation. The gross volume of envelopes arriving in Lock Box receives the same indiscriminate detailed processing. As a result, important late arriving checks miss cash letter deadlines. Float is not minimized. Sheer labor intensive accelerated envelope content processing before cash letter deadlines creates labor scheduling problems, and labor is wasted in the detailed processing of envelope contents whose check is not destined for the upcoming cash letter. Time is also wasted in Transit prior to the outgoing cash letter deadline by processing checks that are not destined for the immediate cash letter. Processing a greater volume of checks prior to a cash letter deadline increases Transit processing time which in turn moves the cut-off time for checks from Lock Box into Transit earlier. The result is an increase in float for late arriving checks in Lock Box.

Large retail organizations, or those who process remittances for large retail organizations, form another user group for applicant's invention. Retail organizations typically route all remittances through their own remittance processing operations. Nationwide, checks are generally directed to a few addresses. The retail remittance processing operations open the envelopes and record relevant data before forwarding the checks to one or several major depositary bank(s) for collection. The depositary bank receiving the checks that are not for large amounts individually, although they may be for a large amount in sum, can not accelerate their processing with present means at a competitive per item cost. The checks are sorted by the bank in a non-accelerated manner according to check clearing organizations and make the next available cash letter. Days of float may result within this system. Days of float reduce earnings for the retail organization.

Given the float resulting from present remittance processing operations, in a bank Lock Box or in a large scale remittance processing operation, it is the goal of the present invention to enable check processing operations to reduce float by providing the capacity up front to discover and prioritize incoming mail (i.e. unopened envelopes) according to indications of clearing organizations of likely enclosed checks. The check processing operation can subsequently prioritize the processing of envelope contents in accordance with fluctuations in the rate of mail delivery and in accordance with crucial outgoing communications/transportation deadlines related to the check collection system. The invention permits optimization of the processing of envelope contents so that the time before crucial in-house deadlines is not wasted by processing checks unnecessary for the immediate cash letter. Thereby, the float is reduced, and manpower is economically utilized. Such a process utilized in a Lock Box operation would enable important cut-off deadlines for checks from the Lock Box operation to a Transit operation to be moved closer to the Transit outgoing cash letter deadline, which increases the number of late arriving checks submitted for collection. Only checks destined for the immediate cash letter would be presented to Transit shortly before the crucial outgoing deadline. During periods when the in coming mail volume is high, such a procedure permits Lock Box processing to concentrate only on those envelopes potentially containing checks destined to clear through Transit for the immediate outgoing cash letter. During periods when relatively infrequent and low volumes of mail are received, the processing of all checks in Lock Box can be brought to a current state. Increased Transit processing time during reduced mail volume periods involves minimal waste because there are relatively few checks arriving late in Lock Box. The operation can closely approach the goal of having detected and processed, out of the backlog of all arrived mail, all envelopes potentially containing checks destined for clearing organizations at the time of a clearing organizations outgoing cash letter deadline.

Therefore, it is an object of the present invention to enable prioritized processing of envelopes potentially containing checks by enabling an up front sorting of unopened envelopes according to encoded indicia of the clearing organizations utilized by the payor banks of the potentially enclosed checks. The encoded indicia might be of the payor bank's check clearing organization(s) themselves or of the drawer's geographic location or zip code.

It is a further object of the present invention to enable sorting of unopened envelopes according to encoded indicia of clearing organizations utilized by the payor banks of potentially enclosed checks in the envelopes, by supplying to potential drawers an address, an envelope, intelligence, information or other material which is to be returned, in some fashion, by the drawer with remittances. The address, envelope, intelligence, information or other material encodes the indicia and is readable without opening the envelope.

It is a further object of the present invention to permit sorting of unopened envelopes according to encoded indicia of the clearing organization of payor banks of potentially enclosed checks in an improved manner whereby the information encoded in the address, envelope, intelligence or other material, supplied to the drawer and returned by some fashion with an envelope delivering the check, is updated when processing of the check reveals that the check will clear through a different clearing organization than that used in the past.

SUMMARY OF THE INVENTION

It should be understood in the present application that a reference to "a" or "the" clearing organization(s) refers to one or more clearing organizations that may be used by a given payor bank. A clearing organization might be a clearing house bank, a clearing house association, a Federal Reserve Bank district or office or the payor bank itself.

"Check" stands for any financial instrument that is processed utilizing clearing organizations.

"Reading" may be by human or by any automated process, now existing or later developed. Reading of encoded indicia may be by optic, magnetic or other means.

"Payee address" as used in the context of this invention assumes a broad meaning, covering literal and non-literal applications. In its literal application, "payee address" means information supplied to a drawer of checks sufficient to direct the delivery of an envelope containing a remittance to the payee or the payee's agent. (The information, in fact, may not all be necessary to perform that directing function). In its non-literal application, "payee address" means any intelligence, information, envelope or material supplied to a drawer of checks which is included in some fashion by the drawer with the envelope delivering the check, either by the literal physical return of the envelope or the material or by including the intelligence or information somewhere with the check and envelope. In this non-literal application, the "payee address" need not direct the delivery of the envelope.

"Unopened" is intended to imply "not necessarily opened". An envelope being read and sorted could literally be an opened envelope without changing the invention. The capacity up front to discover information about the contents of an envelope before the contents are dispersed and processed is the feature highlighted by the word "unopened".

The "envelope" will typically be a mail piece, but it might be a package delivered by any means. "Material" includes envelopes.

Envelopes sorted according to encoded indicia of clearing organization(s) can additionally be sorted by other criteria. The clearing organization is intended to be one criteria that affects the sort. The encoded indicia of a check's clearing organization(s) may not have a unique referent; that is, the indicia may only indicate that any enclosed check will likely clear through one of a given subset of all possible clearing organizations.

In accordance with the present invention, a method is provided for using a payee address, comprised of intelligence, information or returnable materials, supplied to a drawer of checks, to convey information that encodes indicia of the clearing organization(s) utilized by the drawer's payor bank, such as the drawer's clearing organization itself or the drawer's geographic location or zip code. The payee address is supplied in a manner which makes likely the inclusion of the encoded indicia with an envelope delivering the drawer's check and included in such a way that the encoded indicia is readable from the unopened envelope.

In accordance with another aspect of the present invention, a method is provided for enabling selective processing of envelopes by sorting delivered unopened envelopes up front according to encoded indicia of clearing organization(s) of likely enclosed checks, the remittor having been supplied with payee address information. The payee address information accompanies the envelope delivering the check and encodes the indicia in a manner readable from the unopened envelope.

In accordance with another aspect of the present invention, the payee address supplied to the remittor is updated when processing of a check indicates that the remittor's checks will clear through a different clearing organization or in a different geographic location or zip code than that anticipated from the past.

In accordance with another aspect of the present invention, the indicia is encoded in a supplied payee address by inclusion either in the last four digits of a nine digit zip code or in information on one or more line(s) above the bottom line of the supplied address.

In accordance with another aspect of the present invention, the indicia is encoded in a bar code on an envelope or on materials supplied to the remittor.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof which are illustrated in the drawings, which drawings form a part of this specification. It is to be noted, however, that the appended drawings illustrate only the typical embodiments of the invention and are therefore not to be considered limiting of its scope, for the invention may admit to other equally effective embodiments.

In the Drawings.

DESCRIPTION OF THE PREFERRED EMBODIMENT

Figure 1:
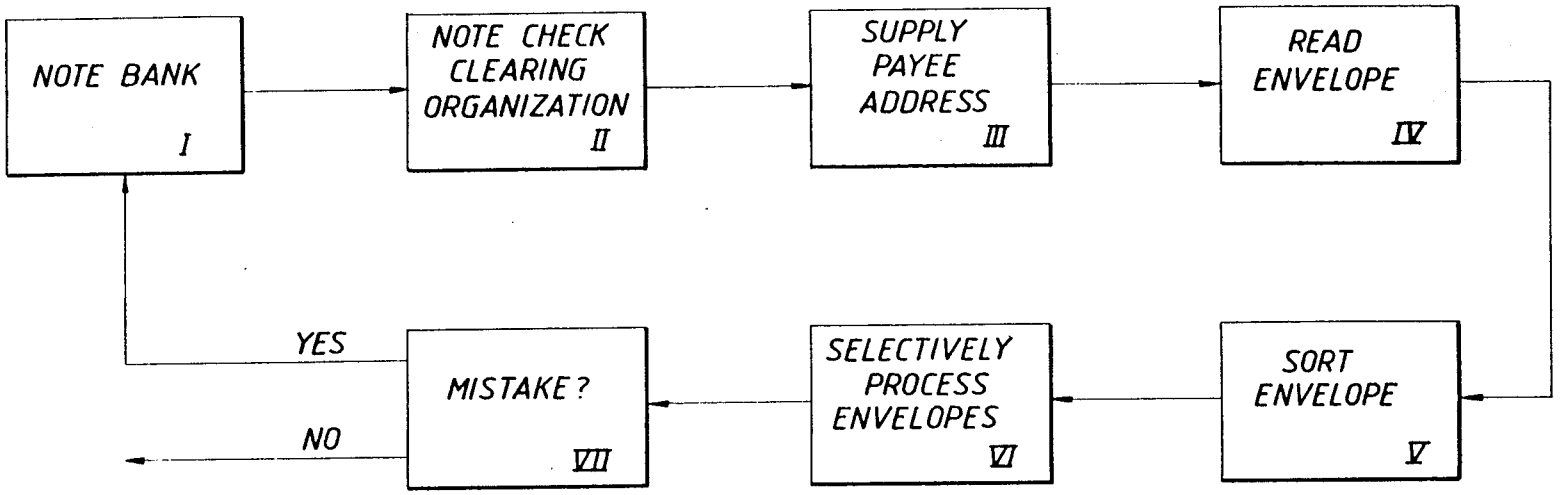
FIG. 1 is a logic block diagram showing one preferred embodiment of the present invention in a Lock Box operation.

The preferred embodiment of FIG. 1 illustrates the use of the invention in a Lock Box operation. The stage denominated I represents the stage in which a Lock Box operation determines, from checks payable to the order of a Lock Box customer (payee), the check's drawer's payor bank. A presumption is made that each remittor (payor) regularly utilizes only one payor bank for a given Lock Box customer (payee). Such a presumption tracks normal practice.

In the stage denominated II the Lock Box operation determines the clearing organization(s) utilized by the payor bank. This information is generally available. The checks of remittors to Lock Box operations are typically of such high dollar value as to make this effort worthwhile.

In the stage denominated III the Lock Box operation furnishes to the Lock Box customer payee address information. The Lock Box customer supplies this payee address to each of the Lock Box customer's remittors. That payee address directs remittances to the Lock Box operation and encodes indicia of the clearing organization(s) utilized by each drawer's payor bank. The remittors include the supplied payee address information with envelopes delivering remittance checks. The payee addresses, which encode the indicia, are designed to be readable from the remittor's unopened envelope.

The payee address information might take the form of a mailing address that, among other things, directs the delivery of the drawer's envelope to the payee's agent, the Lock Box. The mailing address accompanies the drawer's own envelopes. Machine printed addresses are generally machine readable. The address might be readable through an envelope window.

The payee address might take the form of preprinted envelopes. Such envelopes display the encoded indicia by any mark on the front or back, readable in a variety of ways. The payee address information could be supplied by any marked material to be returned with remittances, the marked material being readable from an unopened envelope, as through an envelope window.

The indicia of the clearing organization(s) might be encoded in the last four digits of a supplied mailing address's nine digit zip code. The encoding of the indicia might take place in marks appearing on a line above the bottom line of a supplied mailing address. The encoding might take place by placing a bar code on envelopes or materials supplied to the drawer. An intermediary agent in the envelope delivery process, such as the U. S. Postal Service, might read a nine digit zip code on a mailing address and translate the zip code into a bar code affixed to the envelope. Any method of encoding is sufficient, as long as the information is "readable" from an unopened envelope, either by humans or by any automated reading equipment.

Encoding should be accomplished in a manner that facilitates automatic reading of the information, such as by optical address readers, bar code readers or combinations thereof. Optical readers at present read zip codes and/or one or more lines above the bottom line of the address. Optical or bar code readers read bar codes affixed to the envelope, on either the front or the back, or bar codes printed on contents within the envelope and visible through an envelope window(s) for purposes of automated read. If the Lock Box customer supplies actual material, be it an envelope or any other, to the remittor to be physically included with a remittance, applicant's invention only requires that indicia encoded on the supplied materials be readable while the envelope is unopened, or in any event, prior to dispersal of the envelope's contents.

In the stage denominated IV, the envelopes are delivered to the Lock Box with the supplied indicia encoded. The Lock Box operation reads, either automatically or otherwise, the encoded indicia from the unopened envelope.

In the stage denominated V, each unopened envelope is sorted by the Lock Box operation based on the encoded clearing organization indicia detected.

In the stage denominated VI, the delivered and sorted envelopes are selectively processed in a manner determined by encoded indicia of check clearing organization(s). The order of the detailed follow up processing in the Lock Box operation is a function of in-house deadlines for making cash letters. The in-house deadlines are a function of the clearing organization(s) in question and of the transportation/communication options available.

Checks destined for the clearing organization with the most immediate cash letter deadline receive follow up Lock Box processing first. Using applicant's discovery and selective processing system, there will be few checks in the "backlog" of the Lock Box processing system that are destined for a given clearing organization at the time of its cash letter deadline. This is, of course, a function of the mail delivery schedule, of the speed of the mechanism which sorts incoming Lock Box mail by encoded indicia and of the Lock Box follow-up processing time per envelope. High speed envelope sorters typically sort 500 envelopes per minute. The sorting process on a mail delivery of 10,000 envelopes, for example, should be completed typically in 20 minutes (a function of the "pick-off" rate on the envelopes).

Applicant's invention permits a Lock Box to concentrate detailed follow-up processing on the contents of those envelopes containing checks destined to be included in the next cash letter. If the checks from the Lock Box operation must be processed through a bank central service area, or a Transit check processing/sorting operation, applicant's invention presents a further advantage. Immediately prior to a cash letter deadline during peak mail delivery times, the Lock Box operation can present Transit with checks only destined to be included in that particular cash letter. The total number of checks out of the Lock Box operation to Transit shortly before a deadline will be significantly less than the total number of checks out of the Lock Box utilizing the prior unselective Lock Box processing systems. The Transit processing time required for crucial checks from Lock Box prior to a deadline is thus reduced. The Lock Box operation's cut-off deadline into Transit can be moved later in time. This in turn allows the Lock Box operation to discover and process more envelopes with checks specifically destined for the next cash letter. Detailed processing of the contents of envelopes in Lock Box can be brought to a current state during slow periods of the day with lower volume mail deliveries.

In the stage denominated VII, mistakes are noted. A mistake means a check cannot clear through the clearing organization indicated by the encoded indicia detected from the check's envelope. The appropriate information is cycled back to stage I for updating the encoded information furnished by the Lock Box to the Lock Box customer. In turn, the Lock Box customer supplies updated payee address information to the Lock Box customer's remittor. The corrected encoded indicia in the supplied updated payee address reflects the newly ascertained payor bank clearing organization(s).

Figure 2:
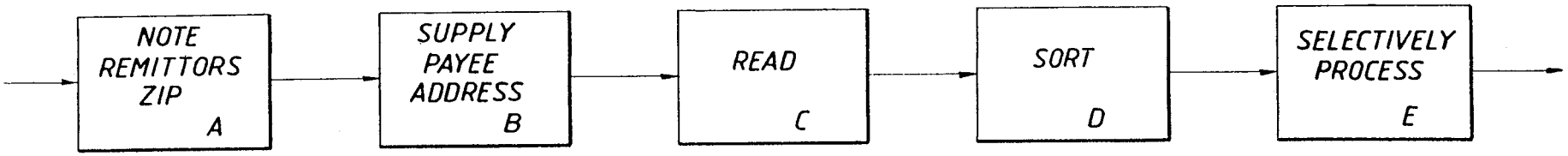
FIG. 2 is a logic block diagram showing another preferred embodiment of the present invention in a retail remittance processing operation.

FIG. 2 illustrates applicant's invention in a retail remittance processing operation. The average dollar value of individual checks in a retail remittance processing operation is not large. The dollar sum, however, is significant due to the large volume of accounts. Determining every potential remittor's payor bank and that payor bank's check clearing organization may be prohibitively expensive for a retail remittance processing operation. The retail remittance processing operation does, however, have access to the remittor's zip code. Studies have shown that a large majority of individuals bank in the area in which they live. The first three digits, for instance, of the zip code of an individual remittor is a good indication of the location of the clearing organization of the remittor's payor bank.

In FIG. 2, Stage A, the retail remittance processing operation determines each remittor's zip code.

In Stage B, each remittor is supplied a payee address for that retail operation which encodes the first three digits of the remittor's own zip code.

In Stages C and D, envelopes delivered to the retail remittance processing operation are read and sorted up front according to the encoded first three digits of the remittor's zip code. The envelopes then, in Stage E, may be selectively processed according to the probable check clearing organization of an enclosed check, as indicated by the encoded first three digits of the remittor's zip code.

A retail remittance processing operation, like a Lock Box operation, operates with a backlog of envelopes waiting to be processed. By enabling prioritized processing of the contents of envelopes according to the probable clearing organization of enclosed checks, the retail remittance processing operation can establish in-house deadlines to meet delivery schedules from the processing operation to various depositary banks. By enabling prioritized processing of the contents of envelopes according to delivery schedules to various depositary banks, the average age of the checks headed for clearing organizations in that depositary bank's area, upon discovery, processing, and gathering for dispatch, can be lowered. This reduces float. In addition, with knowledge of the depositary bank's own in-house deadlines for cash letters, checks destined for a depositary bank can be further presorted by that set of in-house deadlines. Subsequent processing at the depositary bank is expedited.

Given the capacity to sort up front unopened envelopes containing remittances by encoded indicia of the drawer's zip code (or portions thereof), a retail remittance operation might establish a more efficient network of agent depositary banks located in the major zip code areas. Checks emerging from the retail remittance processing operation could be routed to each of these agent depositary banks. These banks, upon receipt of the checks, individually not of large amount but collectively of considerable amount, could afford to acceleratedly process the batch of checks because the bank has reasonable assurance that most will clear locally. Local clearing organization deadlines are speedily met. Considerable float may be saved by this process.

If the retail remittance processing operation continues to send all checks to one depositary bank covering a large geographic area, that depositary bank can none the less acceleratedly process the checks because they can be received pre-sorted according to the various probable clearing organizations of the payor banks. Each batch of checks, segregated according to partial zip code, could be processed in time to meet the depositary bank's next in-house deadline for the cash letter(s) of that zip area. Again, float is reduced.

While a particular embodiment of the invention has been shown and described, it will be understood that the invention is not limited thereto, since many modifications may be made and will become apparent to those skilled in the art.

What is claimed is:

1. Apparatus for improving the efficiency and profitability of a lock box operation by increasing the number of checks included in any cash letter to each check clearing house dealt with by the lock box before the cash letter deadline comprising means for encoding in the address of the envelopes used by the payees information identifying the check clearing housing of the payee's bank or the payee's bank itself, means for reading the encoded information on all incoming mail, means for detailed sorting out of all envelopes from the incoming mail having encoded information indicating those checks that are for the check clearing house having the earliest cash letter deadline, and means for switching the sorting means from the detailed sorting of envelopes having encoded information indicating those checks that are for the check clearing housing having the earliest cash letter deadline to the detailed sorting out of all envelopes having encoded information indicating those checks that are for the check clearing house having the next earliest cash letter deadline, said switch occurring sufficiently before the earliest cash letter deadline to allow the highest priority cash letter to be prepared before its deadline.

2. Apparatus for improving the efficiency and profitability of a lock box operation by increasing the number of checks included in any cash letter to each check clearing house dealt with by the lock box before the cash letter deadline comprising means for encoding in the address of the envelopes used by the payees encoded identification numbers identifying those checks that are for the check clearing house of the payee's bank or the payee's bank, computerized sorting means programmed to use a data base that contains the encoded identification numbers for reading the encoded information on all incoming mail and to sort out in detail all envelopes from the incoming mail having encoded information indicating those checks that are for the check clearing house having the earliest cash letter deadline, and means for switching the sorting means from the sorting of envelopes having encoded address information indicating those checks that are for the check clearing housing having the earliest cash letter deadline to the detailed sorting of envelopes having encoded address information indicating those checks that are for the check clearing housing having the next earliest cash letter deadline, said switch occurring sufficiently before the earliest cash letter deadline to allow the highest priority cash letter to be prepared before its cash letter deadline.

* * * * *